United States Patent [19]

Vick et al.

[11] 3,999,739

[45] Dec. 28, 1976

[54] SNATCH BLOCK

[76] Inventors: Edward L. Vick, 4861 Seven Hills Road, Castro Valley, Calif. 94546; Arlie E. Smith, 3791 Mosswood Drive, Lafayette, Calif. 94549

[22] Filed: May 19, 1975

[21] Appl. No.: 578,395

[52] U.S. Cl. ..... 254/193; 85/5 CP

[51] Int. Cl.[2] ..... B66D 1/36

[58] Field of Search ..... 254/193, 194, 192, 195, 254/196, 191; 85/5 CP; 151/41.7

[56] References Cited

UNITED STATES PATENTS

| | | | |
|---|---|---|---|
| 2,470,686 | 5/1949 | Bryson et al. | 254/193 |
| 2,474,433 | 6/1949 | McKissick | 254/193 |
| 2,584,783 | 2/1952 | Berg | 254/193 |
| 2,633,329 | 3/1953 | Le Bus | 254/193 |
| 3,899,158 | 8/1975 | Johnson | 254/194 |

*Primary Examiner*—Robert J. Spar
*Assistant Examiner*—Kenneth Noland
*Attorney, Agent, or Firm*—Warren, Chickering & Grunewald

[57] ABSTRACT

A snatch block having opposed side sections which may be swung open to admit a cable, rope or other towline into the interior of the block for engaging a sheave journaled for rotation between the side sections and which has an anchorage device such as a hook secured to one of the sections, the particular improvement being in the provision for ready interchangeability of the wide variety of anchorage devices which are required for specific applications.

4 Claims, 5 Drawing Figures

SNATCH BLOCK

BACKGROUND OF THE INVENTION

1. Field of Invention

The invention relates to blocks, i.e., anchorage securing members fitted with a line sheave, adapted for use with towlines and the like and normally positioned at a midpoint of the line. Commonly a winch will be connected to one end of the line and mounted on the object to be moved with the other end of the line connected to an anchorage point, or the position and connection of the winch and line ends may be reversed; and conventionally the snatch block is connected to an anchorage and to a midpoint of the line and is used to control the direction of pull of the line.

2. Description of Prior Art

Conventionally, snatch blocks comprise a line sheave journaled for rotation between a pair of spaced apart opposed side block sections which serve to confine the line on the sheave, and a suitable anchorage device connected to at least one of the sections. Conventionally, the anchorage device is permanently attached to one of the sections so as to be retained thereby when the sections are opened, as is a characteristic of snatch blocks, to admit a midpoint of the line between the sections and onto the sheave. A large number and a wide variety of anchorage devices are required for specific applications. These include a simple swivel hook, a swivel hook with various types of safety gates, a swivel shackle, loose swivel eye and upset shackle, screw pin anchor shackle, swivel jaw and various combinations and forms of the foregoing. Also, the blocks themselves are made in different sizes and strengths. Accordingly, a dealer or user must keep on hand a large inventory of different size blocks fitted with different types of anchorage devices.

SUMMARY OF INVENTION

A primary object of the present invention is to provide a snatch block of the character described which will accommodate, that is support, all of the various different types of head fittings (anchorage devices) above noted, thus greatly reducing the inventory of parts required to be kept by a dealer or user and enabling a dealer to readily furnish specific anchorage devices on a standardized snatch block to meet the individual and widely divergent needs of contractors, industrial users, shippers, loggers, stevedores, construction companies, oil field users, utility companies, etc.

Another object of the present invention is to provide a snatch block of the character described in which the interchangeability of different anchorage devices may be accomplished quickly and easily and with the use of minimum and normally available tools.

The invention possesses other objects and features of advantage, some of which of the foregoing will be set forth in the following description of the preferred form of the invention which is illustrated in the drawing accompanying and forming part of this specification. It is to be understood, however, that variations in the showing made by the said drawing and description may be adopted within the scope of the invention as set forth in the claims.

BRIEF DESCRIPTION OF THE DRAWING

Referring to the drawing.

DETAILED DESCRIPTION OF INVENTION

Figure 1:
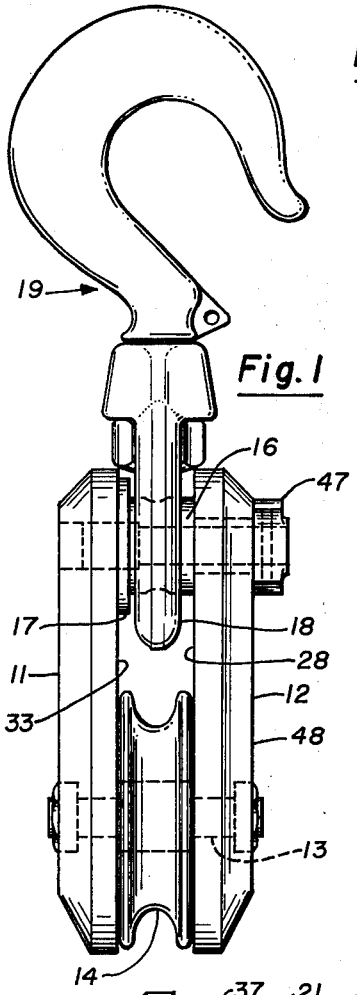
FIG. 1 is a side elevation of a snatch block constructed in accordance with the present invention with an anchorage device connected thereto.
Figure 2:
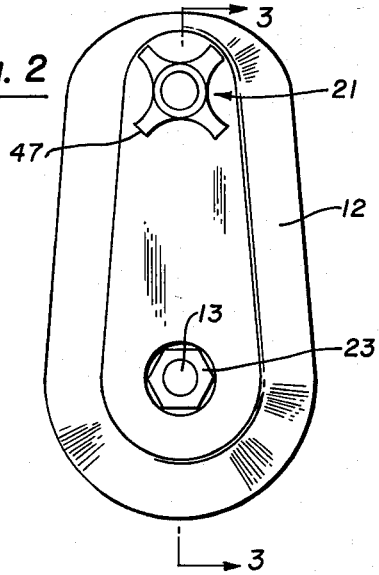
FIG. 2 is a front elevation of the snatch block.
Figure 3:
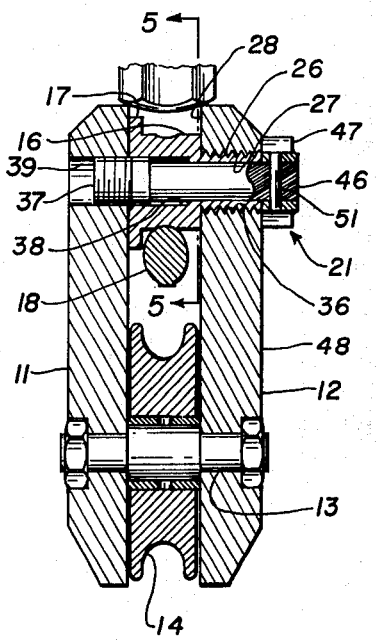
FIG. 3 is a cross-sectional view taken substantially on the plane of line 3—3 of FIG. 2 and showing also a portion of the anchorage device.

The snatch block of the present invention comprises briefly a pair of opposed spaced apart sections 11 and 12; a shaft 13 connecting sections 11 and 12 for relative rotation for moving of the sections into and out of opposed relation (compare FIGS. 1 and 4); a sheave 14 mounted on shaft 13; a member 16 demountably connected to one of the sections 12 and extending therefrom and having a relatively enlarged part 17 for retaining on member 16 an encircling portion 18 of an anchorage device 19; and means 21 detachably securing member 16 to the other section 11 for securing the sections in opposed position, as illustrated in FIGS. 1, 2 and 3. The sheave mounting may be of conventional construction in which the opposite ends of shaft 13 are secured to sections 11 and 12 by nuts 22 and 23, and the hub of sheave 14 is mounted on a bearing 24 surrounding shaft 13.

In conventional block structure the anchorage device holding member, such as member 16, has been welded or otherwise permanently secured to one of the side sections of the block. Consequently, while the other side of the block may be opened to admit the towline as above described, the particular anchorage device with which the block is manufactured is permanently retained with the block. In contrast, the anchorage mounting member 16 of the present device is detachably secured to section 12 so that the attaching member may be removed from the section when the snatch block is opened so as to permit interchangeability of other types of anchorage devices. Specifically, member 16 is here formed with a threaded end 26 which is screwed into a threaded opening 27 in section 12, and the enlarged part 17 is formed as a flange at the opposite end of the member which is spaced from the interior surface 28 of section 12 so as to confine the encircling portion 18 of the anchorage device therebetween. Also, preferably the threaded end 26 of the member is reduced so as to define a shoulder 29 which will abut the interior surface 28 of section 12 when member 16 is screwed home into the section. An annular recess 31 may be formed on member 16 to assist in centering the anchor portion 18 thereon.

As will also be observed with reference to FIGS. 1 and 3, the enlarged end 17 of member 16 provides a flat end surface 32 which abuts the interior surface 33 of section 11 in the opposed, closed position of the block; and means 21 functions to clamp section 11 against the flat end section 32 of member 31.

Figure 4:
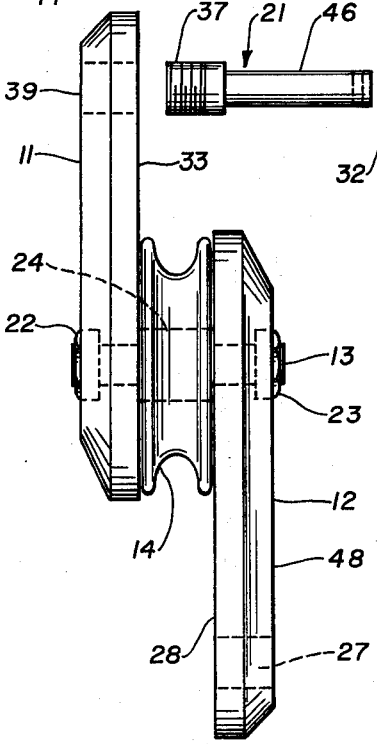
FIG. 4 is an exploded view showing the various parts of the present snatch block and with the latter in an open position.
Figure 4:
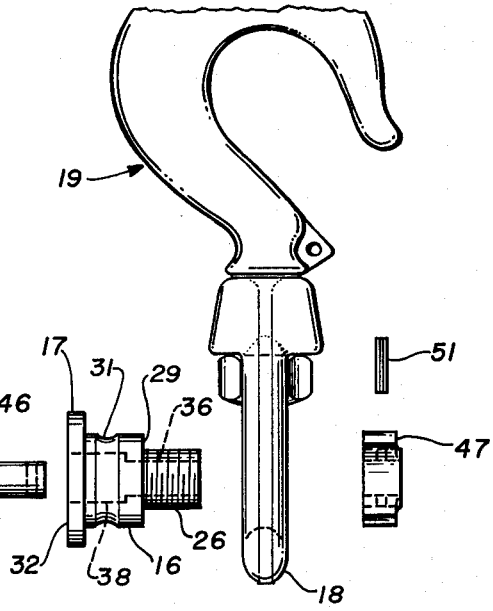
Figure 5:
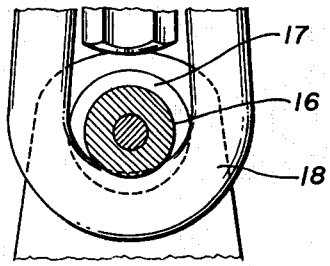
FIG. 5 is a fragmentary cross-sectional view of the snatch block taken substantially on the plane of line 5—5 of FIG. 3.

As an important feature of the present construction, member 31 is formed with a bore 36, and means 21 is mounted in bore 36 and is provided with a part 37 demountably secured to section 11. More specifically, bore 36 extends longitudinally through member 16 between its opposite ends 26 and 32 and is formed with an enlarged bore portion 38 opening to end surface 32. Sections 11 and 12 are formed with openings 39 and 27 in axial registration with bore 36, opening 27 being heretofore identified as receiving the threaded end 26 of member 16. Co-functioning with the foregoing, means 21 here comprises an elongated member having an enlarged threaded part 37, positioned for longitudinal and rotational movement in the enlarged bore portion 38 and advanceable into threaded engagement with threads provided in section opening 39. Importantly, the enlarged threaded part 37 of member 21 is dimensioned for retraction into the enlarged bore portion 38 wherein the threaded part 37 is spaced from and free of connection with section 11, thus to permit rotational opening movement of the sections about shaft 13. It would also be noted that member 21 is provided with a stem portion 46 which extends completely through the opening 27 in section 12 to the exterior side of the section; and a handle 47 is demountably secured to the stem at the exterior side 48 of section 12 and functions to clamp the sections together in the advanced position of threaded part 37, and additionally functions to retain member 21 in bore 36 when the parts are in block open position as illustrated in FIG. 4. Securing of handle 47 to stem 46 may be simply effected by inserting a roll pin 51 through registering openings formed in the handle and stem. The attachment of handle 47 to stem 46 keeps all of the parts associated until they are deliberately disassociated by the dealer or user for the purpose of changing the anchorage device. To change the anchoring device, handle 47 is manually engaged and rotated, in a counterclockwise direction as seen in FIG. 2, to retract the threaded end 37 of pin member 21 from section 11. Thereupon the sections may be swung about shaft 13 to their open position, as shown in FIG. 4, to either admit a cable, or as a first step in the changing of the anchorage device. Where the anchorage device is to be changed, the next step is to remove pin 51 from handle 47 and stem 46. This may be simply accomplished by using a drive pin and hammer or the like. With the removal of handle 47, pin member 21 may be withdrawn from section 12 and bushing member 16, withdrawing the pin to the left as seen in FIG. 3. Bushing member 16 may then be unthreaded from its connection to section 12, thus unmounting the particular anchorage device 19 then associated with the block. Any type of anchorage device having an encircling portion dimensioned to fit around bushing member 16 may be used with the present block. This may be any of the many types of anchorage devices or simply a plate formed with an opening or a looped end of a cable. The encircling portion of the selected anchorage device is then fitted over the midsection of member 16, and the latter is threaded into section 12 so as to retain the anchorage device between the interior surface 28 of section 12 and the enlarged part 17 of member 16. Of course, in each instance the enlarged part 17 must be sufficiently large to confine the encircling part 18 of the anchorge device. After mounting the selected anchorage device in place as above described, the stem 46 of member 21 is inserted into bushing member 16 through the enlarged bore portion 38 with the stem drawn through section 12 so as to retract the threaded end 37 of member 21 completely into the enlarged bore. In this position of the parts, sections 11 and 12 may be swung about shaft 13 to their closed position moving threaded opening 39 in section 11 into registration with threaded end 37 of part 21. Handle 47 is slipped over the outer end of stem 46 and pin 51 inserted through registered openings in the handle and stem to lock the handle in place on the stem. The handle may then be manually engaged to advance and rotate locking member 21 so as to thread end portion 37 into threaded opening 39 in section 11. The parts are so dimensioned that handle 47 will tighten down against the exterior surface 48 of section 12 thereby clamping section 11 against the end face 32 of member 16 and the sections in their opposed closed position.

What is claimed is:

1. A snatch block having a pair of spaced apart side sections and a shaft connecting said sections for relative rotation into and out of opposed relation and a sheave mounted on said shaft, the improvement providing for interchangeable mounting on said block of standard anchorage devices and comprising:

a first member having a first end demountably secured to the interior side of a first of said sections and projecting therefrom into abutment with the interior side of the other (second) section for retaining on said member and between said sections an encircling portion of any of a plurality of standard anchorage devices, said member being formed with a bore extending longitudinally therethrough and having an enlarged bore portion opening to the other (second) end;

an enlongated second member mounted for longitudinal and rotational movement in said bore and having a first end projecting through and exteriorly of said first section and an enlarged second end mounted in said enlarged bore portion and formed for demountable securing to said second section, said enlarged second end of said second member being dimensioned for retraction into said enlarged bore portion free of connection to said second section to permit rotational movement of said sections about said shaft; and a handle secured to said first end of said second member and positioned and formed to bear against the exterior side of said first section to clamp said second section against said first member in the position of said second member secured to said second section, and to retain said second member in said bore in the open position of said sections.

2. A snatch block as defined in claim 1, said first member having a relatively enlarged part at its second end sized to retain on said first member said encircling portion of said anchorage device in the open position of said sections.

3. A snatch block as defined in claim 2, said sections having opposed threaded openings aligned on an axis parallel to and spaced from said shaft; and said first end of said first member and said second end of said second member being threadably engaged in said openings to provide their said demountable securing.

4. A snatch block as defined in claim 3, said handle being demountably connected to said first end of said second member to permit disassembly of said first and second members and demounting of said first member from said first section for interchanging anchorage devices.

* * * * *